US011214761B2

(12) United States Patent
Pelletier et al.

(10) Patent No.: US 11,214,761 B2
(45) Date of Patent: Jan. 4, 2022

(54) SOLID PERFUME COMPOSITION DELIVERING FABRIC CARE

(71) Applicant: Henkel IP & Holding GmbH, Duesseldorf (DE)

(72) Inventors: Maxime Pelletier, Sandy Hook, CT (US); Daniel Thomas Piorkowski, Fairfield, CT (US)

(73) Assignee: Henkel IP & Holding GmbH, Duesseldorf (DE)

( * ) Notice: Subject to any disclaimer, the term of this patent is extended or adjusted under 35 U.S.C. 154(b) by 86 days.

(21) Appl. No.: 16/731,746

(22) Filed: Dec. 31, 2019

(65) Prior Publication Data

US 2021/0198601 A1 Jul. 1, 2021

(51) Int. Cl.

| | |
|---|---|
| ***C11D 3/50*** | (2006.01) |
| ***C11D 3/06*** | (2006.01) |
| ***C11D 11/00*** | (2006.01) |
| ***C11D 3/12*** | (2006.01) |
| ***C11D 3/37*** | (2006.01) |
| ***C11D 3/00*** | (2006.01) |

(52) U.S. Cl.

CPC ..... *C11D 3/505* (2013.01); *C11D 3/0021* (2013.01); *C11D 3/06* (2013.01); *C11D 3/124* (2013.01); *C11D 3/3746* (2013.01); *C11D 11/0017* (2013.01); *C11D 11/0082* (2013.01)

(58) Field of Classification Search

CPC ..... C11D 3/0021; C11D 3/06; C11D 3/50; C11D 3/505; C11D 3/124; C11D 3/3746; C11D 11/0017; C11D 3/2075; C11D 17/044; C11D 3/2079

See application file for complete search history.

(56) References Cited

U.S. PATENT DOCUMENTS

| | | | | |
|---|---|---|---|---|
| 6,024,943 | A | 2/2000 | Ness et al. | |
| 6,056,949 | A | 5/2000 | Menzi et al. | |
| 6,194,375 | B1 | 2/2001 | Ness et al. | |
| 6,458,754 | B1 | 10/2002 | Velazquez et al. | |
| 8,426,353 | B2 | 4/2013 | Ouali et al. | |
| 2009/0293210 | A1* | 12/2009 | Hochberg | C11D 3/3776 8/648 |
| 2011/0224127 | A1 | 9/2011 | Blyth et al. | |
| 2013/0326824 | A1* | 12/2013 | Somerville Roberts | C11D 3/2093 8/137 |
| 2018/0094227 | A1* | 4/2018 | Tantawy | C11D 1/12 |
| 2019/0119608 | A1 | 4/2019 | Schmiedel et al. | |
| 2019/0185785 | A1 | 6/2019 | Seiler et al. | |

* cited by examiner

*Primary Examiner* — John R Hardee
(74) *Attorney, Agent, or Firm* — Bojuan Deng

(57) ABSTRACT

The present disclosure provides compositions for fabric treatment having at least one dye transfer inhibitor (DTI), at least one water-soluble carrier, at least one fragrance, and at least one buffer system, and other optional ingredients. During a wash cycle, the compositions disclosed herein significantly boost color fading protection of fabrics. The present disclosure further provides a method of making a composition for fabric treatment, including mixing a water-soluble carrier and a buffer system to form a mixture; adding a dye transfer inhibitor (DTI) and a fragrance into the mixture; mixing the mixture; heating the mixture and obtaining a melt thereby; and cooling the mixture. The method can further include shaping the melt into individual particles having melt bodies, which can optionally be in the form of a pastille.

18 Claims, No Drawings

SOLID PERFUME COMPOSITION DELIVERING FABRIC CARE

FIELD OF THE INVENTION

This application relates to fragranced compositions for fabric treatment that contain a dye transfer inhibitor ("DTI"), and methods for the use and manufacture thereof.

BACKGROUND OF THE INVENTION

When treating and/or laundering fabrics, consumers often want not only to wash, clean or maintain the fabrics to be treated, but also to have additional benefits. For example, consumers prefer that colored fabrics do not fade from washing and/or drying. Consumers can choose detergents and/or fabric softeners having ingredients that provide a baseline level of color fading protection. For example, chlorine scavengers can be used to provide baseline level color protection. However, consumers may desire greater degrees of color fading protection than the baseline level provided by common chlorine scavengers.

Color-care ingredients, and other beneficial ingredients are typically included as an integral component of a washing or cleaning agent. However, the ability to separately meter a solid composition comprising one or more beneficial agents into the washing drum at the start of a washing cycle allows consumers to control the amount of benefit agent provided to the laundry through customized metering. For example, solid compositions comprising melt bodies containing fragrance are already available to consumers. Consumers can add varying amounts of this solid composition to the washing drum to meter the amount of fragrance delivered to laundry. However, these compositions do not provide boosted effective color-fading protection to fabrics.

Accordingly, a need exists for solid compositions to effectively boost color fading protection of textiles in the presence of a detergent during a wash cycle.

BRIEF SUMMARY OF THE INVENTION

The compositions and methods provided in the present disclosure are exemplary and are not intended to limit the scope of the claims.

The present inventors surprisingly found that adding the disclosed composition for fabric care, comprising at least one dye transfer inhibitor (DTI) and at least one buffer system, during a wash cycle significantly boosts color fading protection of fabrics washed with the composition compared to fabrics washed without the ingredients disclosed herein.

In one aspect, the present disclosure provides a solid, particulate composition for fabric treatment comprising from about 20 to about 95 wt. % of at least one water-soluble carrier selected from aqueous salts, wherein the aqueous salts have a water vapor partial pressure at a particular temperature in the range of from 30 to 100° C. that corresponds to the $H_2O$ partial pressure of a saturated solution of said salts; from about 0.1 to about 2 wt. % of at least one dye transfer inhibitor (DTI); from about 0.1 to about 20 wt. % of at least one fragrance; and from about 0.1% to about 10 wt. % of at least one buffer system; wherein wt. % is based on the total weight of the solid, particulate composition.

In one aspect, the DTI is present in the composition for fabric treatment at an amount of from about 0.1% to about 2% by weight of the composition.

In another aspect, the composition for fabric treatment further comprises a rheology modifier.

In another aspect, the composition for fabric treatment further comprises an emulsifying substance.

In another aspect, the composition for fabric treatment further comprises a colorant.

In another aspect, the composition for fabric treatment further comprises a bittering agent.

In another aspect, the composition for fabric treatment further comprises a solvent.

In another aspect, the composition for fabric treatment further comprises water.

In another aspect, the disclosure provides a method of making a composition for fabric treatment, comprising: mixing a water-soluble carrier and a buffer system to form a mixture; adding a dye transfer inhibitor (DTI) and a fragrance into the mixture; mixing the mixture; heating the mixture and obtaining a melt thereby; and cooling the mixture. In another aspect, the method further comprises shaping or forming the melt into individual particles comprising melt bodies. In one aspect, the melt bodies are cooled to form a pastille. In additional aspects, the composition can be in the form of a granule, a pellet, a powder, a pulverized powder, or a tablet. In one aspect, the melt bodies can be in an amorphous form. In one aspect, the melt bodies can be in a crystalline or partially crystalline form.

In another aspect, the disclosure provides a method of color fading protection to a textile, either alone or in combination with one or more other beneficial agents, for example, fragrance, to a textile, comprising contacting the textile with a composition of the present disclosure.

DETAILED DESCRIPTION OF THE INVENTION

Definitions

All of the various aspects and options disclosed herein can be combined in any and all variants unless otherwise specified. Terms in this application control in the event of a conflict with a patent or publication term that is incorporated by reference.

As used herein, "a," "an," or "the" means one or more unless otherwise specified.

Open terms such as "include," "including," "contain," "containing," and the like mean "comprising."

The act of treating a textile can refer to, for example, one or more of: i) delivering color fading protection to a textile, ii) applying a perfume to a textile; iii) applying a perfume and delivering color fading protection to a textile; iv) softening a textile; or any combination thereof.

The term "or" can be conjunctive or disjunctive.

Some aspects contemplate numerical ranges. Every numerical range provided herein includes the range endpoints as individual aspects. When a numerical range is provided, all individual values and sub-ranges therein are present as if explicitly written out.

The terms "textile" and "fabric" can be used interchangeably.

The term "fragrance" refers to free fragrances and encapsulated fragrances. The terms "fragrance," "free fragrance," "encapsulated fragrance," and "perfume" can be used interchangeably.

The term "about" is synonymous with the term "approximately," and includes the recited number 10% or 5%. For example, "about 10" means 9 to 11. Also as an example, a temperature of approximately 50° C. means 45-55° C., or 47.5° C.-52.5° C. Unless indicated otherwise, all percentages indicated are percentage by weight.

The term "at least one," refers to one or more, for example 1, 2, 3, 4, 5, 6, 7, 8, 9 or more. In particular, this information refers to the type of agent/compound and not to the absolute number of molecules. "At least one fragrance" therefore means that at least one type of fragrance is included, but that two or more different types of fragrances can also be included.

The term "water-soluble" refers to solubility in water at 20° C. of at least 1 g/L, or at least 10 g/L, or at least 50 g/L.

The term "melt" is synonymous with "melt dispersion." The term "melt" refers to the liquid state of the composition disclosed herein, before it is cooled. The melt and/or melt dispersion is the liquid state of matter of the composition for fabric treatment disclosed herein. Following cooling, the melt becomes a solid composition for fabric treatment.

The term "melt body" is used herein to describe the solid particles than can be obtained from the liquid composition through solidification/shaping when it is cooled.

The terms "composition for fabric treatment," and "CFT" can be used synonymously with the term "melt body."

The term "melting temperature" refers to the temperature at which a composition converts from a solid form to a liquid form.

Compositions for Fabric Treatment ("CFTs")

The present disclosure provides a solid, particulate composition for fabric treatment ("CFT"). The CFTs can be used, for example, to treat a textile.

The CFTs described herein can be used, for example, in the washing cycle of a laundry or fabric cleaning method to provide color fading protection to the laundry and/or fabric at any time during the fabric cleaning method, including at the beginning of the fabric cleaning method. The CFTs can further provide additional beneficial agents, including, but not limited to a fragrance, to the washed fabrics. A method for treating textiles or fabrics, during which a CFT of the present disclosure is added into a washer containing said textiles or fabrics, is a further subject of this application.

The CFT of the present disclosure comprises a plurality of melt bodies.

In one aspect, the melt bodies can have a particle size of between about 0.5 mm and about 10 mm, or between about 0.8 mm to about 7 mm, or about 1 mm to about 3 mm in any spatial direction.

In one aspect, the melt bodies can have a particle weight of between about 2 mg and about 150 mg, or between about 4 mg and about 60 mg, or between about 5 mg and about 10 mg.

The melt bodies are desirably solid at room temperature, for example, at about 25° C., and soluble in the usual working temperature ranges of a wash and/or rinse cycle, and can deliver a color fading protection to fabrics during a wash cycle.

In one aspect, the melt bodies are solid at temperatures from about 20° C. to about 40° C. In one aspect, the melt bodies are solid at temperatures of about 20° C., 25° C., 30° C., 35° C., or 40° C.

In one aspect, the melt bodies are uncoated, coated, waxed, powdered, or a combination thereof.

In one aspect, a method of making the melt bodies comprises: mixing a water-soluble carrier and a buffer system to form a mixture; adding a dye transfer inhibitor (DTI) and a fragrance into the mixture; mixing the mixture; heating the mixture and obtaining a melt thereby; and cooling the mixture. In one aspect, the melt is shaped into individual particles comprising melt bodies.

In one aspect, the melt is pressed into a heated inner body and a drum-shaped outer tube which is provided with a large number of holes and which rotates concentrically about the stationary inner body, thereby depositing product drops over the entire width of a continuous cooling belt, preferably a steel belt.

The viscosity (measured by a Texas Instruments AR-G2 Rheometer; plate/plate, 4 cm diameter, 1100 m gap; shear rate 10/1 sec) of the mixture as it leaves the rotating, perforated outer drum is between about 100 mPas and about 1,000 mPas. The viscosity is measured at elevated temperatures, for example at about 70° C.

The drops of the mixture output from the drop former are solidified to form solid melt bodies on the steel belt. The period of time between the mixture being dropped onto the steel belt and the mixture completely solidifying is preferably between about 5 seconds and about 60 seconds.

The solidification of the mixture can be assisted and accelerated by cooling. The drops output onto the steel belt can be cooled either directly or indirectly. Suitable cooling methods include but are not limited to (1) direct cooling with cold air and (2) indirect cooling by cooling the underside of the steel belt by means of cold water.

The melt bodies can be of any desired shape. The shaping takes place before the melt is cooled. Solid, particulate shapes such as substantially spherical, hemispherical, lentil shaped, oblong shaped, figure-like, flake-shaped, cuboid, cylindrical, cone-shaped, spherical-cap-shaped or lens-shaped, hemispherical, disk-shaped or needle-shaped particles are suitable for SCTFs of the disclosure. For example, the particles can have a gummy-bear, figure-like design. Melt bodies having a hemispherical shape can advantageously be prepared by means of pastillation.

In one aspect, the melt bodies are uncoated, coated, waxed, powdered, or a combination thereof. Coatings known from the pharmaceutical literature, for example, are suitable as a coating agent. However, the CFTs can also be waxed, i.e. coated in a wax, or powdered with a powdered material, such as a release agent, for protection from caking (agglomeration). In one aspect, the coating does not contain PEG in a significant amount (>10% by weight based on the coating).

In one aspect, the melt bodies of the present disclosure can be used to deliver color fading protection to textiles or fabrics. For example, the CFTs of the present disclosure can be combined with a conventional washing or cleaning composition and brought into contact with the textiles or fabrics, together with a laundry detergent, during the washing cycle of a conventional washing and cleaning process or during hand-washing to deliver color fading protection and fragrance to the washed textiles.

Methods for preparing the melt bodies of the present disclosure described in U.S. patent application Ser. No. 16/162,640, which is incorporated by reference herein in its entirety.

In one aspect, the CFT of the present disclosure can be in the form of a pastille, a granule, a pellet, a powder, a pulverized powder, or a tablet. To make tablets or pellets, the ingredients in the CFTs can be blended together, for example, at room temperature, and compressed to form tablets or pellets. The blends can be dry powder blends. The CFT can be in an amorphous form, a crystalline form, or a partially crystalline form.

In aspect, the CFT of the present disclosure can comprise some or all of the ingredients listed below.

Dye Transfer Inhibitor(s)

Dye transfer inhibitors (DTIs) are typically used to prevent dye from dissolving or transferring to other fabrics during washing and/or cleaning of dyed fabrics.

The DTI in the CFT of the present disclosure prevents dye transfer of fabrics washed with the CFT. Surprisingly, the inventors found that the addition of the DTI significantly slowed down color fading of the washed fabrics.

The combination of the buffer system and the DTI in the CFT of the present disclosure unexpectedly provides a significant boost to color fading protection of fabrics washed with the CFT.

In one aspect, the CFT of the present disclosure can include a DTI. In one aspect, the DTI can be a water-soluble DTI.

In one aspect, the CFT comprises a DTI that is a polymer or a copolymer of cyclic amines such as vinylpyrrolidone and/or vinylimidazole. In one aspect, the DTI can be polyvinylpyrrolidone (PVP), polyvinylimidazole (PVI), copolymers of vinylpyrrolidone and vinylimidazole (PVP/PVI), polyvinylpyridine-N-oxide, poly-N-carboxymethyl-4-vinylpyridium chloride and mixtures thereof. In one aspect, the DTI can be vinylpyrrolidone/vinylimidazole copolymers, vinylpyrrolidone/vinylimidazole homopolymers, and polyvinylpyrrolidone homopolymers. In another aspect, the DTI can be a homopolymer or copolymer of polyvinylpyrrolidone (PVP). In another aspect, the DTI can be a 97% active vinylpyrrolidone/vinylimidazole (PVP/PVI) copolymer in granule format.

In one aspect, the DTI can be present in an amount of from about 0.01% to about 5.0% by weight, or from about 0.01% to about 4.0% by weight, or from about 0.1% to about 3.0% by weight, or from about 0.1% to about 2.0% by weight, or from about 0.1% to about 1.5% by weight, or from about 0.1% to about 1% by weight, or from about 0.15 to about 0.75% by weight, or from about 0.15 to about 0.5% by weight, or from about 0.15 to about 0.35% by weight of the CFT. In one aspect, the DTI can be present in an amount of about 0.15% by weight, or about 0.20% by weight, or about 0.25% by weight, or about 0.30% by weight, or about 0.35% by weight, or about 0.40% by weight, or about 0.45% by weight, or about 0.5% by weight, or about 0.6% by weight, or about 0.7% by weight, or about 0.8% by weight, or about 0.9% by weight, or about 1.0% by weight, or about 1.2% by weight, or about 1.4% by weight, or about 1.6% by weight, or about 1.8% by weight, or about 2.0% by weight, or about 2.5% by weight, or about 3.0% by weight, or about 3.5% by weight, or about 4.0% by weight, or about 4.5% by weight, or about 5.0% by weight of the CFT, or a range between any two of the preceding values.

In one aspect, the DTI can be present in an amount of about 0.15%, or about 0.25%, or about 0.35%, or about 0.45%, or about 0.55%, or about 0.65%, or about 0.75%, or about 0.85%, or about 0.95%, or about 1.0%, about 1.15%, or about 1.25%, or about 1.35%, or about 1.45%, or about 1.55%, or about 1.60%, or about 1.65%, or about 1.75%, or about 1.80%, or about 1.85%, or about 1.90%, or about 1.95%, or about 2.0%, by weight of the composition.

Exemplary DTIs include, but are not limited to SOKALAN® HP polyvinylpyrrolidon (PVP) homopolymers including: SOKALAN® HP56, (BASF), SOKALAN® HP20, SOKALAN® HP165, (BASF), SOKALAN® HP50, (BASF), SOKALAN® HP53, (BASF), SOKALAN® HP56 granules, (BASF), SOKALAN® HP56 K, (BASF), SOKALAN® HP66 K, (BASF), CHROMABOND™ S-100 (Ashland), REILLINE™ 350 (Vertellus) and combinations thereof.

Water Soluble Carrier(s)

In one aspect, the CFT of the present disclosure can include a water-soluble carrier that is an aqueous salt wherein the water vapor partial pressure at a temperature of from about 30° C. to about 100° C., or usual working temperature ranges in a wash and/or rinse cycle, corresponds to the water ($H_2O$) partial pressure of the saturated solution of the salt. The water-soluble carriers of the present disclosure demonstrate this behavior at a temperature of from about 30° C. to about 100° C., or from about 40° C. to about 90° C., or from about 50° C. and about 85° C., or from about 55° C. and about 80° C.

The water-soluble carrier material is selected from aqueous salts of which the water vapor partial pressure at a temperature in the range of from 30 to 100° C. corresponds to the $H_2O$ partial pressure of the saturated solution of said salt at said temperature. This leads to the corresponding aqueous salt, also referred to herein as a "hydrate," dissolving in the water of crystallization thereof when said temperature is reached or exceeded and thus transitioning from a solid to a liquid state of matter. In a formulation for melt bodies, an aqueous salt (hydrate) as a carrier material of which the water vapor partial pressure at a particular temperature in the range of from 30 to 100° C. corresponds to the $H_2O$ partial pressure of the saturated solution of said salt at said temperature such that the salt dissolves in the water of crystallization thereof at said temperature, which is a process that can be phenomenologically described as melting, but is in fact a dissolution process, thermodynamically speaking. The water soluble carrier is described in U.S. patent application Ser. No. 16/162,640, which is incorporated by reference herein in its entirety.

In one aspect, the CFT of the present disclosure can include a water soluble carrier. In one aspect, the water-soluble carrier can be an aqueous salt. In one aspect, the water-soluble carrier can be sodium acetate or a hydrate thereof. In one aspect, water-soluble carrier can be water free sodium acetate. In one aspect, the water-soluble carrier can be sodium acetate trihydrate ($Na(CH_3COO).3H_2O$), sodium sulfate ($Na_2SO_4$. $10H_2O$), trisodium phosphate dodecahydrate ($Na_3PO_4.12H_2O$) and strontium chloride hexahydrate ($SrCl_2.6H_2O$).

In one aspect, the water-soluble carrier is sodium acetate trihydrate ($Na(CH3COO).3H_2O$).

In another aspect, the water-soluble carrier is water-free sodium acetate. In one aspect the water-free sodium acetate is used in combination with free water. In one aspect, sodium acetate trihydrate can form in situ when water-free sodium acetate is used in combination with free water. In such aspects, the water can be used in a substoichiometric or hyperstoichiometric amount based on the amount that is necessary to convert all of the sodium acetate into sodium acetate trihydrate, for example, in an amount of at least about 60% by weight, or at least about 70% by weight, or at least about 80% by weight, or at least about 90% by weight, or at about 100% by weight, or more, based on the weight of the CFT, which is the amount that is theoretically necessary to convert all of the sodium acetate into sodium acetate trihydrate ($Na(CH_3COO)\cdot 3H_2O$).

In one aspect, the CFT comprises water in a hyperstoichiometric amount. Accordingly, if one aspect in which water-free sodium acetate is used in isolation, or in combination with a hydrate thereof, the trihydrate water is also used, the amount of water corresponding to at least the amount that would be stoichiometrically necessary to ensure that at least about 60% by weight of the total amount of sodium acetate and the hydrates thereof, preferably about 70% by weight, or at least about 80% by weight, or at least about 90% by weight, or at least about 100% by weight, based on the weight of the CFT, is in the form of sodium acetate trihydrate. In one aspect, the amount of water exceeds the amount that would be theoretically necessary to convert all of the sodium acetate into the corresponding trihydrate. This means, for example, that a composition that contains 50% by weight water-free sodium acetate and no hydrate thereof contains at least 19.8% by weight water (60% of 33% by weight that would be theoretically necessary to convert all of the sodium acetate into sodium acetate trihydrate.

In one aspect, the water soluble carrier can be present in an amount of from about 10% by weight to about 95% by weight, or from about 10% by weight to about 90% by weight, or from about 10% by weight to about 85% by weight, or from about 10% by weight to about 80% by weight, or from about 10% by weight to about 75% by weight, or from about 10% by weight to about 70% by weight, or from about 10% by weight to about 60% by weight, or from about 20% by weight to about 95% by weight, or from about 25% by weight to about 95% by weight, or from about 30% by weight to about 95% by weight, or from about 35% by weight to about 95% by weight, or from about 40% by weight to about 90% by weight, or from about 45% by weight to about 90% by weight of the CFT.

Fragrance(s) or Perfume(s)

In one aspect, the CFT of the present disclosure comprises at least one fragrance. In one aspect, the fragrance has a melting point that is in the range of from about −100° C. to about 100° C., or from about −80° C. to 80° C., or from about −20° C. to about 50° C., or from about −30° C. to about 20° C. In one aspect, the CFT comprises a fragrance having a melting point that is in the range of from about 25° C. to 400° C., or from about 50° C. to about 380° C., or from about 75° C. to about 350° C., or from about 100° C. to about 330° C.

In one aspect, the fragrance can be an ester, an ether, an aldehyde, a ketone, an alcohol, a hydrocarbon, an essential oil, and a combination thereof.

In one aspect, the fragrance can be, for example, adoxal (2,6,10-trimethyl-9-undecenal), anisaldehyde (4-methoxybenzaldehyde), cymal (3-(4-isopropyl-phenyl)-2-methylpropanal), ethylvanillin, florhydral (3-(3-isopropylphenyl) butanal), helional (3-(3,4-methylenedioxyphenyl)-2-methylpropanal), heliotropin, hydroxycitronellal, lauraldehyde, lyral (3- and 4-(4-hydroxy-4-methylpentyl)-3-cyclohexene-1-carboxaldehyde), methyl nonyl acetaldehyde, lilial (3-(4-tert-butylphenyl)-2-methylpropanal), phenyl acetaldehyde, undecylenaldehyde, vanillin, 2,6,10-trimethyl-9-undecenal, 3-dodecen-1-al, alpha-n-amylcinnamaldehyde, melonal (2,6-dimethyl-5-heptenal), 2,4-dimethyl-3-cyclohexene-1-carboxaldehyde (triplal), 4-methoxybenzaldehyde, benzaldehyde, 3-(4-tert-butylphenyl)propanal, 2-methyl-3-(para-methoxyphenyl)propanal, 2-methyl-4-(2,6,6-timethyl-2(1)-cyclohexen-1-yl)butanal, 3-phenyl-2-propenal, cis-/trans-3,7-dimethyl-2,6-octadien-1-al, 3,7-dimethyl-6-octen-1-al, [(3,7-dimethyl-6-octenyl) oxy]acetaldehyde, 4-isopropylbenzylaldehyde, 1,2,3,4,5,6,7,8-octahydro-8,8-dimethyl-2-naphthaldehyde, 2,4-dimethyl-3-cyclohexene-1-carboxaldehyde, 2-methyl-3-(isopropylphenyl)propanal, 1-decanal, 2,6-dimethyl-5-heptenal, 4-(tricyclo[5.2.1.0(2,6)]decylidene-8)butanal, octahydro-4,7-methano-1H-indenecarboxaldehyde, 3-ethoxy-4-hydroxybenzaldehyde, para-ethyl-alpha,alpha-dimethylhydrocinnamaldehyde, alpha-methyl-3,4-(methylenedioxy)hydrocinnamaldehyde, 3,4-methylenedioxybenzaldehyde, alpha-n-hexylcinnamaldehyde, m-cymene-7-carboxaldehyde, alpha-methyl phenylacetaldehyde, 7-hydroxy-3,7-dimethyloctanal, undecanal, 2,4,6-trimethyl-3-cyclohexene-1-carboxaldehyde, 4-(3)(4-methyl-3-pentenyl)-3-cyclohexenecarboxaldehyde, 1-dodecanal, 2,4-dimethylcyclohexene-3-carboxaldehyde, 4-(4-hydroxy-4-methylpentyl)-3-cylohexene-1-carboxaldehyde, 7-methoxy-3,7-dimethyloctan-1-al, 2-methylundecanal, 2-methyldecanal, 1-nonanal, 1-octanal, 2,6,10-trimethyl-5,9-undecadienal, 2-methyl-3-(4-tert-butyl)propanal, dihydrocinnamaldehyde, 1-methyl-4-(4-methyl-3-pentenyl)-3-cyclohexene-1-carboxaldehyde, 5- or 6-methoxyhexahydro-4,7-methanoindane-1- or -2-carboxaldehyde, 3,7-dimethyloctan-1-al, 1-undecanal, 10-undecen-1-al, 4-hydroxy-3-methoxybenzaldehyde, 1-methyl-3-(4-methylpentyl)-3-cyclohexenecarboxaldehyde, 7-hydroxy-3J-dimethyloctanal, trans-4-decenal, 2,6-nonadienal, para-tolylacetaldehyde, 4-methylphenylacetaldehyde, 2-methyl-4-(2,6,6-trimethyl-1-cyclohexen-1-yl)-2-butenal, ortho-methoxycinnamaldehyde, 3,5,6-trimethyl-3-cyclohexenecarboxaldehyde, 3J-dimethyl-2-methylene-6-octenal, phenoxyacetaldehyde, 5,9-dimethyl-4,8-decadienal, peony aldehyde (6,10-dimethyl-3-oxa-5,9-undecadien-1-al), hexahydro-4,7-methanoindane-1-carboxaldehyde, 2-methyloctanal, alpha-methyl-4-(1-methylethyl)benzene acetaldehyde, 6,6-dimethyl-2-norpinene-2-propionaldehyde, para-methylphenoxyacetaldehyde, 2-methyl-3-phenyl-2-propen-1-al, 3,5,5-trimethylhexanal, hexahydro-8,8-dimethyl-2-naphthaldehyde, 3-propyl-bicyclo-[2.2.1]-hept-5-ene-2-carbaldehyde, 9-decenal, 3-methyl-5-phenyl-1-pentanal, methyl nonyl acetaldehyde, hexanal and trans-2-hexenal.

In one aspect, the fragrance can be, for example, methyl beta-naphthyl ketone, musk indanone (1,2,3,5,6,7-hexahydro-1,1,2,3,3-pentamethyl-4H-inden-4-one), tonalide (6-acetyl-1,1,2,4,4,7-hexamethyltetralin), alpha-damascone, beta-damascone, delta-damascone, iso-damascone, damascenone, methyl dihydrojasmonate, menthone, carvone, camphor, koavone (3,4,5,6,6-pentamethylhept-3-en-2-one), fenchone, alpha-ionone, beta-ionone, gamma-methyl ionone, fleuramone (2-heptylcyclopentanone), dihydrojasmone, cis-jasmone, Iso E Super (1-(1,2,3,4,5,6J,8-octahydro-2,3,8,8-tetramethyl-2-naphthalenyl)ethan-1-one (and isomers)), methyl cedrenyl ketone, acetophenone, methyl acetophenone, para-methoxyacetophenone, methyl beta-naphtyl ketone, benzyl acetone, benzophenone, para-hydroxyphenylbutanone, celery ketone (3-methyl-5-propyl-2-cyclohexenone), 6-isopropyldecahydro-2-naphtone, dimethyl octenone, frescomenthe (2-butan-2-ylcyclohexan-1-one), 4-(1-ethoxyvinyl)-3,3,5,5-tetramethylcyclohexanone, methyl heptenone, 2-(2-(4-methyl-3-cyclohexen-1-yl)propyl)cyclopentanone, 1-(p-menthen-6(2)yl)-1-propanone, 4-(4-hydroxy-3-methoxyphenyl)-2-butanone, 2-acetyl-3,3-dimethylnorbornane, 6,7-dihydro-1,1,2,3,3-pentamethyl-4(5H)indanone, 4-damascol, dulcinyl(4-(1,3-benzodioxol-5-yl)butan-2-one), Hexalon (1-(2,6,6-trimethyl-2-cyclohexen-1-yl)-1,6-heptadien-3-one), isocyclemone E (2-acetonaphthone-1,2,3,4,5,6,7,8-octahydro-2,3,8,8-tetramethyl), methyl nonyl ketone, methyl cyclocitrone, methyl lavender ketone, orivone (4-tert-amylcyclohexanone), 4-tert-butylcyclohexanone, delphone (2-pentyl cyclopentanone), muscone (CAS 541-91-3), neobutenone (1-(5,5-dimethyl-1-cyclohexenyl)pent-4-en-1-one), plicatone (CAS 41724-19-0), veloutone (2,2,5-trimethyl-5-pentylcyclopentan-1-one), 2,4,4,7-tetramethyloct-6-en-3-one and tetrameran (6,10-dimethylundecen-2-one).

In one aspect, the fragrance can comprise, for example, 10-undecen-1-ol, 2,6-dimethylheptan-2-ol, 2-methylbutanol, 2-methylpentanol, 2-phenoxyethanol, 2-phenylpropanol, 2-tert-butylcyclohexanol, 3,5,5-trimethylcyclohexanol, 3-hexanol, 3-methyl-5-phenylpentanol, 3-octanol, 3-phenylpropanol, 4-heptenol, 4-isopropylcyclohexanol,4-tert-butylcyclohexanol, 6,8-dimethyl-2-nonanol, 6-nonen-1-ol, 9-decen-1-ol, α-methylbenzyl alcohol, α-terpineol, amyl salicylate, benzyl alcohol, benzyl salicylate, 8-terpineol, butyl salicylate, citronellol, cyclohexyl salicylate, decanol, dihydromyrcenol, dimethyl benzyl carbinol, dimethyl heptanol, dimethyl octanol, ethyl salicylate, ethyl vanillin, eugenol, farnesol, geraniol, heptanol, hexyl salicylate, isoborneol, isoeugenol, isopulegol, linalool, menthol, myrtenol, n-hexanol, nerol, nonanol, octanol, p-menthan-7-ol, phenylethyl alcohol, phenol, phenyl salicylat, tetrahydrogeraniol, tetrahydrolinalool, thymol, trans-2-cis-6-nonadicnol, trans-2-nonen-1-ol, trans-2-octenol, undecanol, vanillin, champiniol, hexenol and cinnamyl alcohol.

In one aspect, the fragrance can be, for example, for example, benzyl acetate, phenoxyethyl isobutyrate, p-tert-butylcyclohexyl acetate, linalyl acetate, dimethyl benzyl carbinyl acetate (DMBCA), phenyl ethyl acetate, benzyl acetate, ethylmethylphenyl glycinate, allyl cyclohexyl propionate, styralyl propionate, benzyl salicylate, cyclohexyl salicylate, floramat, melusat and jasmacyclat.

In one aspect, the fragrance can be, for example, for example, benzyl ethyl ether and ambroxan. The hydrocarbons include mainly terpenes, such as limonene and pinene.

In one aspect, the fragrance can be a mixtures of various fragrances, which can be referred to as a perfume or perfume oil. Perfume oils of this kind can also contain natural fragrance mixtures, as are obtainable from plant sources.

In one aspect, the fragrance can be, for example, essential oils such as angelica root oil, anise oil, arnica blossom oil, basil oil, bay oil, champaca blossom oil, citrus oil, silver fir oil, silver fir cone oil, elemi oil, eucalyptus oil, fennel oil, pine needle oil, galbanum oil, geranium oil, ginger grass oil, guaiac wood oil, gurjun balsam oil, helichrysum oil, ho oil, ginger oil, iris oil, jasmine oil, cajeput oil, calamus oil, chamomile oil, camphor oil, canaga oil, cardamom oil, cassia oil, pine needle oil, copaiba balsam oil, coriander oil, spearmint oil, caraway oil, cumin oil, labdanum oil, lavender oil, lemongrass oil, lime blossom oil, lime oil, mandarin oil, balm oil, mint oil, musk seed oil, muscatel oil, myrrh oil, clove oil, neroli oil, niaouli oil, olibanum oil, orange blossom oil, orange oil, origanum oil, palmarosa oil, patchouli oil, peru balsam oil, petitgrain oil, pepper oil, peppermint oil, pimento oil, pine oil, rose oil, rosemary oil, sage oil, sandalwood oil, celery oil, spike oil, star anise oil, turpentine oil, thuja oil, thyme oil, verbena oil, vetiver oil, juniper berry oil, wormwood oil, wintergreen oil, ylang-ylang oil, hyssop oil, cinnamon oil, cinnamon leaf oil, citronella oil, lemon oil and cypress oil and ambrettolide, ambroxan, alpha-amylcinnamaldehyde, anethol, anisaldehyde, anise alcohol, anisol, anthranilic acid methyl ester, acetophenone, benzyl acetone, benzaldehyde, benzoic acid ethyl ester, benzophenone, benzyl alcohol, benzyl acetate, benzyl benzoate, benzyl formate, benzyl valerianate, borneol, bornyl acetate, boisambrene forte, alpha-bromostyrene, n-decyl aldehyde, n-dodecyl aldehyde, eugenol, eugenol methyl ether, eucalyptol, farnesol, fenchone, fenchyl acetate, geranyl acetate, geranyl formate, heliotropin, heptine carboxylic acid methyl ester, heptaldehyde, hydroquinone dimethyl ether, hydroxycinnamaldehyde, hydroxycinnamyl alcohol, indol, irone, isoeugenol, isoeugenol methyl ether, isosafrole, jasmone, camphor, carvacrol, carvone, p-cresol methyl ether, cumarin, p-methoxyacetophenone, methyl n-amyl ketone, methyl anthranilic acid methyl ester, p-methyl acetophenone, methyl chavicol, p-methyl quinoline, methyl beta-naphthyl ketone, methyl n-nonyl acetaldehyde, methyl n-nonyl ketone, muscone, beta-naphthol ethyl ether, beta-naphthol methyl ether, nerol, n-nonyl aldehyde, nonyl alcohol, n-octyl aldehyde, p-oxy-acetophenone, pentadecanolide, beta-phenyl ethyl alcohol, phenyl acetic acid, pulegone, safrole, salicylic acid isoamyl ester, salicylic acid methyl ester, salicylic acid hexyl ester, salicylic acid cyclohexyl ester, santalol, sandelice, skatole, terpineol, thymene, thymol, troenan, gamma-undelactone, vanillin, veratrum aldehyde, cinnmaldehyde, cinnamyl alcohol, cinnamic acid, cinnamic acid ethyl ester, cinnamic acid benzyl ester, diphenyl oxide, limonene, linalool, linalyl acetate and propionate, melusat, menthol, menthone, methyl n-heptenone, pinene, phenyl acetaldehyde, terpinyl acetate, citral, citronellal, and mixtures thereof.

In one aspect, the fragrance can have, for example, a musky scent, a pungent scent, a camphoraceous scent, an ethereal scent, a floral scent, a peppermint scent, or any combination thereof.

In one aspect, the fragrance can comprise methyl formate, methyl acetate, methyl butyrate, ethyl butyrate, isoamyl acetate, pentyl butyrate, pentyl pentanoate, octyl acetate, myrcene, geraniol, nerol, citral, citronellol, linalool, nerolidol, limonene, camphor, terpineol, alpha-ionone, thujone, benzaldehyde, eugenol, cinnamaldehyde, ethyl maltol, vanillin, anisole, anethole, estragole, thymol, indole, pyridine, furaneol, 1-hexanol, cis-3-hexenal, furfural, hexyl cinnamaldehyde, fructone, hexyl acetate, ethyl methyl phenyl glycidate, dihydrojasmone, oct-1-en-3-one, 2-acetyl-1-pyrroline, 6-acetyl-2,3,4,5-tetrahydropyridine, gamma-decalactone, gamma-nonalactone, delta-octalone, jasmine lactone, massoia lactone, wine lactone, sotolon, grapefruit mercaptan, methanthiol, methyl phosphine, dimethyl phosphine, nerolin, 2,4,6-trichloroanisole, or any combination thereof.

In one aspect, the fragrance can comprise a linear terpene, a cyclic terpene, an aromatic compound, a lactone, a thiol, or any combination thereof.

Other art-known fragrances, or any fragrance commercially available from a fragrance supplier (for example, Firmenich, Givaudan, International Flavors and Fragrances (IFF), Symriseetc.), or combinations of such fragrances, may also suitably be used in the CFTs, compositions, and methods disclosed herein.

In one aspect, the fragrance can be a fragrance precursor. "Fragrance precursor" refers to compounds which only release the actual fragrance following chemical conversion/separation, for example, when exposed to light or other environmental conditions, such as pH, temperature, etc. Compositions of this kind are often referred to as pro-fragrances.

In one aspect, the fragrance can be encapsulated, for example, in a microcapsule or a nanocapsule. The microcapsules and nanocapsules can be water-soluble or water-insoluble. In one aspect, all of the fragrance is encapsulated. Examples of encapsulated fragrances are described in, for example, U.S. Pat. Nos. 6,024,943, 6,056,949, 6,194,375, 6,458,754 and 8,426,353, and US 2011/0224127 A1, each of which is incorporated by reference in its entirety. In one aspect, the fragrance can be a free fragrance, a fragrance precursor, or an encapsulated fragrance, or any combination thereof.

In one aspect, the fragrance is present in the CFT in an amount from about 0.1% by weight to about 25.0% by weight, or from about 0.1% by weight to about 20% by weight, or from about 0.5% by weight to about 20% by weight, or from about 0.5% by weight to about 15% by weight, or from about 1% by weight to about 15% by weight, or from about 1% by weight to about 12% by weight, or from about 1.0% to about 5% by weight, or from about 3% by weight to about 12% by weight, based on the total weight of the CFT.

Buffer System(s)

The present inventors surprisingly found that adding DTI to the CFT of the present disclosure prevents color fading of fabrics washed with the CFT. The buffer system is added to the CFT to buffer the effect of acids (i.e., acetic acid, resulting from sodium acetate of the water-soluble carrier), and the buffer system also has some chlorine scavenging properties. Without wishing to be bound by theory, it is believed that the buffer system of the CFT, in combination with the DTI, provides a significant boost to the color fading protection of fabrics washed with the CFT of the present disclosure.

In one aspect, the CFT of the present disclosure comprises at least one buffer system. In one aspect, the buffer system(s) can be a solid buffer system, i.e. a solid (mixture) under standard conditions.

In one aspect, the buffer system comprises a chlorine scavenger.

In one aspect, the buffer system is TRIS.

In one aspect, the buffer system has a pKa of at least about 5.75, or at least about 6.25, or at least about 6.75, and no more than about 12, or less than about 11.5, or about 11 or less, or about 10.5 or less.

In one aspect, the buffer system of the present disclosure is such that, when 1 g of the composition is dissolved in 50 g of deionized water, a pH of about 12, or of about 11.5, or of about 11, is not exceeded, and the buffer capacity of the resultant solution is at least about 2 mg HCl/g of the composition, or at least about 3 mg HCl/g of the composition, or at least about 4 mg HCl/g of the composition.

In one aspect, buffer system can be present in an amount from about 0.1% by weight to about 10% by weight, or from about 0.5% to about 7.5% by weight, or from about 1% by weight to about 5% by weight, based on the total weight of the CFT.

Rheology Modifier

In one aspect, the CFT of the present disclosure comprises at least one rheology modifier. In one aspect, the rheology modifier can be an inorganic rheology modifier and/or an organic rheology modifier.

In one aspect, the rheology modifier can be an inorganic rheology modifier such as, for example, silica. Suitable silicas include highly dispersed silicas, such as those having BET surfaces areas of more than about 50 $m^2/g$, or more than about 100 $m^2/g$, or from about 150 $m^2/g$ to about 250 $m^2/g$, or from about 175 $m^2/g$ to about 225 $m^2/g$. In one aspect, inorganic rheology modifier can be pyrogenic silica. In one aspect the rheology modifier is a highly dispersed silica having a BET surface area of between about 50 $m^2/g$ to about 225 $m^2/g$.

Suitable silicas are commercially available from Evonik under the trade names that are known in the art, such as, for example, Aerosil® and Sipernat®.

In one aspect, the rheology modifier can be an organic rheology modifier. In one aspect, the organic rheology modifier can be cellulose. A suitable cellulose microfibrillated cellulose (MFC, nanocellulose). In one aspect, the rheology modifier can be microfibrillated cellulose.

Suitable MFCs are commercially available under various trade names that are known in the art, for example, as Exilva (Borregaard) or Avicel® (FMC).

In one aspect, the CFT of the present disclosure includes at least one inorganic silica or at least one organic silica. In one aspect, the CFT of the present disclosure includes at least one inorganic silica and at least one organic silica.

In one aspect, the CFT rheology modifier is present in amounts of from about 0.1% by weight to about 40% by weight, or from about 0.1% by weight to about 25% by weight, based on the total weight of the CFT.

Emulsifying Substance(s)

In one aspect, the CFT of the present disclosure further comprises an emulsifying substance. In one aspect, the emulsifying substance can be a non-ionic surfactant, cationic surfactant, or anionic surfactant.

In one aspect, the emulsifying substance can include, for example, fatty alcohols, such as stearyl alcohol, fatty alcohol alkoxylates, such as fatty alcohol alkoxylates used as non-ionic surfactants, fatty alcohol and fatty alcohol ether sulfates and alkyl benzene sulfonates, in particular those that are also used as anionic surfactants, are suitable. Suitable fatty alcohol ethoxylates include C10-22 fatty alcohol ethoxylates having up to 50 EO, C12-18 alkyl ethers having 5-8, or 7 EO, and C16-18 alkyl ethers having up to 30 EO. Suitable fatty alcohol ether sulfates are the sulfates of the above-mentioned fatty alcohol ethers; suitable fatty alcohol sulfates are in particular C10-18 fatty alcohol sulfates and C12-16 fatty alcohol sulfates. Suitable alkyl benzene sulfonates are linear C10-13 alkyl benzene sulfonates.

In one aspect, the emulsifying substance can be fatty alcohols, fatty alcohol alkoxylates, fatty amide ethoxylates, fatty alcohol sulfates, fatty alcohol ether sulfates, alkyl benzene sulfonates, allyl polyglycosides, fatty acid sorbitan esters, alkylamine oxides, alkyl betaines or combinations thereof.

In one aspect, the emulsifying substance can be present in an amount of from about 0.01% by weight to about 20% by weight, or from about 0.10% by weight to about 15% by weight, or from about 0.10% by weight to about 10% by weight, or from about 0.15% to about 2% by weight, or from about 0.15% to about 1% by weight, or from about 0.15 to about 0.5% by weight, or from about 0.15% to about 0.4% by weight, or from about 0.15% to about 0.35% by weight or from about 0.2% by weight to about 0.4% by weight, or from about 0.2% by weight to about 0.35% by weight of the CFT.

Colorant(s)

In one aspect, the CFT of the present disclosure further comprises at least one colorant.

In one aspect, the CFT does not contain a colorant.

In one aspect, the CFT contains one or more colorants. In one aspect, the colorant can be a water-soluble polymer, water-insoluble polymer, a water-soluble dye, a water-insoluble dye, or a combination thereof.

In one aspect, the colorant(s) can be, for example, red, orange, yellow, blue, indigo, violet, or any combination thereof.

In one aspect, the colorant(s) can be Violet LS, Royal MC, Blue HP, Blue MC, Aquamarine, Green HMC, Bright Yellow, Yellow LP, Yellow BL, Brilliant Orange, Crimson, Red MX, Pink AL, Red BL, Red ST, Acid Blue 80, Acid Red 52, Acid Violet 48, Liquitint blue HP, Liquitint Bright Yellow Liquid, or a combination thereof.

In one aspect, the colorant(s) can be present in an amount of from about 0.0001% by weight to about 2.0% by weight, or from about 0.0001% by weight to about 1.5% by weight, or from about 0.0001% by weight to about 1.0% by weight, or from about 0.0001% by weight to about 0.5% by weight, or from about 0.001% by weight to about 0.3% by weight, or from about 0.001% by weight to about 0.1% by weight, or from about 0.001% by weight to about 0.05% by weight, or from about 0.001% by weight to about 0.025% by weight, or about 0.001% by weight, or about 0.002% by weight, or about 0.003% by weight, or about 0.0035% by weight of the composition.

Bittering Agent(s)

In one aspect, the CFT of the present disclosure further comprises at least one bittering agent. In one aspect, the bittering agent can be denatonium benzoate.

Solvent(s)

In one aspect, the CFT of the present disclosure further comprises at least one solvent. In one aspect, the solvent can be dipropylene glycol.

Water

In one aspect, the CFT of the present disclosure further comprises free water. As used herein, "free water," refers to water that is not bound in a salt contained in the composition.

PEG(s)

In one aspect, the CFT of the present disclosure does not contain polyethylene glycol ("PEG"), in the form of a coating, that is a solid at room temperature.

In one aspect, the CFT of the present disclosure contains less than about 1% by weight of PEG, in the form of a coating, that is solid at room temperature, by weight of the composition.

Additional Solid(s) and/or Filler(s)

In one aspect, the CFT of the present disclosure comprises additional ingredient(s) known to be employed in compositions for fabric treatment.

The additional ingredient(s) can be, for example, a bleaching agent, a bleach activator, an enzyme, a silicone oil, an anti-re-deposition agent, an optical brightener, a greying inhibitor, a shrink inhibitor, an anti-creasing agent, a color transfer inhibitor, an anti-microbial, a germicide, a fungicide, an antioxidant, an anti-static agent, an ironing aid, a water proofing agent, an impregnation agent, a swelling agent, an anti-slip agent, a UV absorber, a corrosion inhibitor, or any combination thereof. In other aspects, the additive can be one or more viscosity-modifying agents (for example, silica, sodium CMC, and other agents well-known in the art to increase or decrease the viscosity of a liquid or liquid-containing suspension), one or more opacifying agents, and the like. In further aspects, the additional ingredient(s) can be scavengers, including, for example, chlorine scavengers.

The additional ingredient(s) can be, for example, a salt. Salts can include, but are not limited to, alkali metal salt, alkaline earth metal salt, and combinations thereof.

Alkali metal salts can be, for example, salts of lithium, sodium, potassium, rubidium, cesium, francium, or any combination thereof.

Useful alkali metal salts can be, for example, alkali metal fluorides, chlorides, bromides, iodides, sulfates, bisulfates, phosphates, monohydrogen phosphates, dihydrogen phosphates, carbonates, monohydrogen carbonates, acetates, citrates, lactates, pyruvates, silicates, ascorbates, or any combination thereof.

Alkali metal salts can include, for example, sodium fluoride, sodium chloride, sodium bromide, sodium iodide, sodium sulfate, sodium bisulfate, sodium phosphate, sodium monohydrogen phosphate, sodium dihydrogen phosphate, sodium carbonate, sodium hydrogen carbonate, sodium acetate, sodium citrate, sodium lactate, sodium tartrate, sodium silicate, sodium ascorbate, potassium fluoride, potassium chloride, potassium bromide, potassium iodide, potassium sulfate, potassium bisulfate, potassium phosphate, potassium monohydrogen phosphate, potassium dihydrogen phosphate, potassium carbonate, potassium monohydrogen carbonate, potassium acetate, potassium citrate, potassium lactate, potassium tartrate, potassium silicate, potassium ascorbate, or any combination thereof.

Alkaline earth metal salts include, for example, salts of beryllium, magnesium, calcium, strontium, barium, radium, or any combination thereof.

Alkaline earth metal salts can be, for example, alkaline metal fluorides, chlorides, bromides, iodides, sulfates, bisulfates, phosphates, monohydrogen phosphates, dihydrogen phosphates, carbonates, monohydrogen carbonates, acetates, citrates, lactates, pyruvates, silicates, ascorbates, or any combination thereof.

Alkaline earth metal salts can include, for example, magnesium fluoride, magnesium chloride, magnesium bromide, magnesium iodide, magnesium sulfate, magnesium phosphate, magnesium monohydrogen phosphate, magnesium dihydrogen phosphate, magnesium carbonate, magnesium monohydrogen carbonate, magnesium acetate, magnesium citrate, magnesium lactate, magnesium tartrate, magnesium silicate, magnesium ascorbate, calcium fluoride, calcium chloride, calcium bromide, calcium iodide, calcium sulfate, calcium phosphate, calcium monohydrogen phosphate, calcium dihydrogen phosphate, calcium carbonate, calcium monohydrogen carbonate, calcium acetate, calcium citrate, calcium lactate, calcium tartrate, calcium silicate, calcium ascorbate, or any combination thereof.

Salts can include, for example, inorganic salts, such as inorganic alkali metal salts and inorganic alkaline earth metal salts that do not contain carbon.

Salts can include, for example, organic salts, such as organic alkali metal salts and organic alkaline earth metal salt that contain carbon.

The additional ingredient(s) can be, for example, contained in the CFT in an amount ranging from about 0.00001% by weight to about 10% by weight, based on the weight of the CFT.

Some examples of additional ingredients can be, for example, U.S. powdered sugar 10×, DISINTEX 75, polyvinylpyrrolidone K15, sodium sulfate, and sodium chloride.

The CFT can optionally contain further typical ingredients, for example those that improve the application-specific and/or aesthetic properties.

Various formulations of a number of CFTs according to aspects of the disclosure are set forth in the following tables (numerical values are provided in wt. %, based on the total weight of the agent, unless indicated otherwise). TRIS is preferably used as the buffer system.

TABLE 1

| | Formula 1 | Formula 2 | Formula 3 | Formula 4 | Formula 5 |
|---|---|---|---|---|---|
| Dye transfer inhibitor | 0.1 to 1.5 | 0.1 to 1 | 0.15 to 0.75 | .15 to 0.5 | 0.15 to 0.35 |
| Sodium acetate trihydrate | 20 to 95 | 30 to 95 | 30 to 95 | 40 to 90 | 45 to 90 |
| Fragrance | 0.1 to 20 | 0.1 to 20 | 1.0 to 15 | 1.0 to 15 | 3.0 to 12 |

TABLE 1-continued

| | Formula 1 | Formula 2 | Formula 3 | Formula 4 | Formula 5 |
|---|---|---|---|---|---|
| Buffer system | 0.1 to 10 | 0.25 to 8.5 | 0.5 to 7.5 | 0.75 to 6.0 | 1.0 to 5.0 |
| Misc. | ad 100 | ad 100 | ad 100 | ad 100 | ad 100 |

TABLE 2

| | Formula 6 | Formula 7 | Formula 8 | Formula 9 | Formula 10 |
|---|---|---|---|---|---|
| Dye transfer inhibitor | 0.1 to 1.5 | 0.1 to 1 | 0.15 to 0.75 | .15 to 0.5 | 0.15 to 0.35 |
| Sodium acetate trihydrate | 20 to 95 | 30 to 95 | 30 to 95 | 40 to 90 | 45 to 90 |
| Fragrance | 0.1 to 20 | 0.1 to 20 | 1.0 to 15 | 1.0 to 15 | 3.0 to 12 |
| Pyrogenic silica | 1.0 to 2.5 | 1.0 to 2.5 | 1.0 to 2.5 | 1.2 to 2.0 | 1.2 to 2.0 |
| Buffer system | 0.1 to 10 | 0.25 to 8.5 | 0.5 to 7.5 | 0.75 to 6.0 | 1.0 to 5.0 |
| Misc. | ad 100 | ad 100 | ad 100 | ad 100 | ad 100 |

TABLE 3

| | Formula 11 | Formula 12 | Formula 13 | Formula 14 | Formula 15 |
|---|---|---|---|---|---|
| Dye transfer inhibitor | 0.1 to 1.5 | 0.1 to 1 | 0.15 to 0.75 | .15 to 0.5 | 0.15 to 0.35 |
| Sodium acetate trihydrate | 20 to 95 | 30 to 95 | 30 to 95 | 40 to 90 | 45 to 90 |
| Fragrance | 0.1 to 20 | 0.1 to 20 | 1.0 to 15 | 1.0 to 15 | 3.0 to 12 |
| (Microfibrillated) cellulose | 0.1 to 25 | 0.1 to 20 | 0.1 to 18 | 0.1 to 15 | 0.1 to 10 |
| TRIS | 0.1 to 10 | 0.25 to 8.5 | 0.5 to 7.5 | 0.75 to 6.0 | 1.0 to 5.0 |
| Misc. | ad 100 | ad 100 | ad 100 | ad 100 | ad 100 |

TABLE 4

| | Formula 16 | Formula 17 | Formula 18 | Formula 19 | Formula 20 |
|---|---|---|---|---|---|
| Dye transfer inhibitor | 0.1 to 1.5 | 0.1 to 1 | 0.15 to 0.75 | .15 to 0.5 | 0.15 to 0.35 |
| Sodium acetate trihydrate | 20 to 95 | 30 to 95 | 30 to 95 | 40 to 90 | 45 to 90 |
| Fragrance | 0.1 to 20 | 0.1 to 20 | 1.0 to 15 | 1.0 to 15 | 3.0 to 12 |
| Fatty alcohol ethoxylate having from 5 to 50 EO | 0.1 to 10 | 0.1 to 5.0 | 0.2 to 5.0 | 0.2 to 3.0 | 0.5 to 2.0 |
| TRIS | 0.1 to 10 | 0.25 to 8.5 | 0.5 to 7.5 | 0.75 to 6.0 | 1.0 to 5.0 |
| Misc. | ad 100 | ad 100 | ad 100 | ad 100 | ad 100 |

TABLE 5

| | Formula 21 | Formula 22 | Formula 23 | Formula 24 | Formula 25 |
|---|---|---|---|---|---|
| Dye transfer inhibitor | 0.1 to 1.5 | 0.1 to 1 | 0.15 to 0.75 | .15 to 0.5 | 0.15 to 0.35 |
| Sodium acetate trihydrate | 20 to 95 | 30 to 95 | 30 to 95 | 40 to 90 | 45 to 90 |
| Fragrance | 0.1 to 20 | 0.1 to 20 | 1.0 to 15 | 1.0 to 15 | 3.0 to 12 |
| Pyrogenic silica | 1.0 to 2.5 | 1.0 to 2.5 | 1.0 to 2.5 | 1.2 to 2.0 | 1.2 to 2.0 |
| (Microfibrillated) cellulose | 0.1 to 25 | 0.1 to 20 | 0.1 to 18 | 0.1 to 15 | 0.1 to 10 |
| Fatty alcohol ethoxylate having from 5 to 50 EO | 0.1 to 10 | 0.1 to 5.0 | 0.2 to 5.0 | 0.2 to 3.0 | 0.5 to 2.0 |
| TRIS | 0.1 to 10 | 0.25 to 8.5 | 0.5 to 7.5 | 0.75 to 6.0 | 1.0 to 5.0 |
| Misc. | ad 100 | ad 100 | ad 100 | ad 100 | ad 100 |

TABLE 6

| | Formula 26 |
|---|---|
| Sodium acetate trihydrate | 20 to 95 |
| Fragrance | 0.1 to 20 |
| Pyrogenic silica | 1.0 to 2.5 |

TABLE 6-continued

| | Formula 26 |
|---|---|
| (Microfibrillated) cellulose | 0.1 to 25 |
| Fatty alcohol ethoxylate having from 5 to 50 EO | 0.1 to 10 |

TABLE 6-continued

| | Formula 26 |
|---|---|
| TRIS | 0.1 to 10 |
| Misc. | ad 100 |

Methods of Use

The CFTs of the present disclosure can be used to treat fabrics or textiles, for example, to prevent color fading, to impart scent (i.e., apply fragrance to) to a fabric or textile.

In one aspect, the present disclosure provides a method of treating a fabric or a textile comprising combining or contacting the fabric or textile to be treated, with water and a CFT. The amount of CFT can be, for example, about 0.001 g to about 1 kg per treatment. The amount of the CFT can be, for example, about 0.01 g, about 0.1 g, about 1 g, about 2 g, about 3 g, about 4 g, about 5 g, about 6 g, about 7 g, about 8 g, about 9 g, about 10 g, about 25 g, about 50 g, about 100 g, about 200 g, about 300 g, about 400 g, about 500 g, about 600 g, about 700 g, about 800 g, or about 900 g per treatment.

The CFTs can be used in a top loading or front loading washer, in hot, warm, or cold water. The CFTs and laundry compositions can be used with a detergent in a wash cycle, or separately but in conjunction with a detergent (for example, in a separate wash or rinse cycle).

In one aspect, the disclosure provides a textile treated by a CFT, as disclosed herein.

In one aspect, the CFT can be added to an amount of water or wash liquor in which a textile is washed by hand.

The textile, after being treated, can be further processed, for example by drying, pressing, ironing, steaming, sewing, and the like.

The following examples are illustrative and do not limit the scope of the disclosure of the claims.

Example 1

Sodium acetate trihydrate was heated to a temperature of 70° C. and stirred in water to form a mixture. The remaining ingredients listed in Formula 25 (see Table 5) were subsequently added to the mixture in the amounts listed. Melt bodies or pastilles were prepared by dropping the liquid mixture ("melt") onto a cooling plate of which the temperature was adjusted to room temperature (23° C.).

Example 2

A multi-wash test in chlorinated water was designed to assess the effects of the treatment of fabrics with Formula 25 on color fading of the fabrics over time.

Specifically, a ten-wash color-fading test using four different knit fabrics (i.e., a black knit, an orange knit, a blue knit, and a red knit) was used to determine the color fading effects of the CFT of the present disclosure. In particular, three samples of each knit were subjected to 10 wash cycles, which cycles included treatment with the following combinations of agents: (1) detergent only, (2) detergent plus a pastille without any DTI, and (3) detergent, plus 0.35% Sokalan HP56K (DTI) included in the pastille formula. The formulas for each of (1)-(3) are shown below.

TABLE 7

| Detergent Formula | |
|---|---|
| Detergent Formula | % |
| Sodium chloride | 79.20 |
| Sodium Carbonate | 14.28 |
| Methyl ester Sulphonate | 2.10 |
| Polyacrylate | 1.48 |
| Sodium Silicate | 1.32 |
| Water | 1.27 |
| Fragrance | 0.08 |
| Misc | ad 100 |

TABLE 8

| Treatment Agents for Color Fading Test | |
|---|---|
| (1) | Detergent only |
| (2) | Detergent + Formula 26 |
| (3) | Detergent + Formula 25 |

Color fading test data is shown below in Tables 9-12. Lower DE values indicate less color change.

TABLE 9

| Black Knit | | |
|---|---|---|
| Treatment Agent | Statistical Category | Least Square Mean |
| Detergent only | A | 11.910000 |
| Detergent + Formula 26 | B | 4.126667 |
| Detergent + Formula 25 | C | 3.080000 |

TABLE 10

| Orange Knit | | |
|---|---|---|
| Treatment Agent | Statistical Category | Least Square Mean |
| Detergent only | A | 18.813333 |
| Detergent + Formula 26 | B | 13.960000 |
| Detergent + Formula 25 | C | 10.223333 |

TABLE 11

| Blue Knit | | |
|---|---|---|
| Treatment Agent | Statistical Category | Least Square Mean |
| Detergent only | A | 8.9300000 |
| Detergent + Formula 26 | B | 4.4466667 |
| Detergent + Formula 25 | C | 3.380000 |

TABLE 12

| Red Knit | | |
|---|---|---|
| Treatment Agent | Statistical Category | Least Square Mean |
| Detergent only | A | 9.763333 |
| Detergent + Formula 26 | B | 7.046667 |
| Detergent + Formula 25 | C | 3.743333 |

Readings for each knit were performed after 10 warm water washes and dry cycles. The first column shows the treatment agent. The second column indicates the statistical category of the knit fabric sample. Fabric samples with a shared letter (e.g., AB and BC) are not statistically different from each other, and those without a shared letter (e.g., AB and DE) are statistically different from each other. The third column provides the color fade score of the sample fabric as measured by the Phabrometer. Lower DE values indicate less color change.

The results show that fabrics washed and dried with the detergent and a pastille that does not contain any DTI (Detergent+Formula 26) and detergent with a pastille that includes 0.035% DTI (HPK56) (Detergent+Formula 25), are statistically different from each other, and are each statistically different from the fabrics washed with detergent only.

As shown, fabrics washed with the detergent and the pastilles that do not contain any DTI (Sokalan HP56) reduced color fading significantly more, in comparison to the fabrics that were washed with the detergent only. It is believed that the TRIS in Formula 26 acts as a chlorine scavenger and prevents color fading. However, fabrics washed with the detergent and the pastilles with a DTI (Sokalan HP56) contained therein surprisingly exhibited increased color fading protection on fabrics as compared to fabrics washed with detergent and pastilles that do not contain any DTI (Sokalan HP56).

All patents, patent applications, and publications cited herein are fully incorporated by reference herein in their entirety.

The foregoing description has revealed the general nature of the disclosure such that others can, by applying knowledge within the skill of the art, readily modify and/or adapt for various applications such specific aspects, without undue experimentation. Therefore, such adaptations and modifications are intended to be within the meaning and range of equivalents of the disclosed aspects, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

What is claimed is:

1. A solid, particulate composition for fabric treatment, comprising:

(a) from about 20 to about 95 wt. % of at least one water-soluble carrier selected from aqueous salts, wherein said aqueous salts have a water vapor partial pressure at a particular temperature in the range of from 30 to 100° C. that corresponds to $H_2O$ partial pressure of a saturated solution of said salts; wherein said at least one water-soluble carrier comprises sodium acetate trihydrate ($Na(CH_3COO).3H_2O$);

(b) from about 0.1 to about 2 wt. % of at least one dye transfer inhibitor (DTI);

(c) from about 0.1 to about 20 wt. % of at least one fragrance; and (d) from about 0.1% to about 10 wt. % of at least one buffer system; wherein said at least one buffer system comprises tris(hydroxymethyl)aminomethane (TRIS);

wherein wt. % is based on the total weight of the composition.

2. The composition of claim 1, wherein the DTI is selected from the group consisting of polyvinylpyrrolidone (PVP), polyvinylimidazole (PVI), copolymers of vinylpyrrolidone and vinylimidazole (PVP/PVI), polyvinylpyridine-N-oxide, poly-N-carboxymethyl-4-vinylpyridium chloride and mixtures thereof.

3. The composition of claim 1, wherein the fragrance is an ester, an ether, an aldehyde, a ketone, an alcohol, a hydrocarbon, an essential oil, and a combination thereof.

4. The composition of claim 1, wherein the buffer system is such that, when 1 g of the composition is dissolved in 50 g of deionized water, a pH of about 12 is not exceeded, and the buffer capacity of the resultant solution is from about 2 mg HCl/g of the composition to about 4 mg HCl/g of the composition.

5. The composition of claim 1, further comprising at least one rheology modifier, selected from an inorganic rheology modifier, an organic rheology modifier and mixtures thereof, wherein the at least one rheology modifier is present in an amount of from about 0.1% by weight to about 25% by weight of the composition.

6. The composition of claim 5, wherein the inorganic rheology modifier is pyrogenic silica.

7. The composition of claim 5, wherein the organic rheology modifier is a microfibrillated cellulose.

8. The composition of claim 1, further comprising an emulsifying substance selected from the group consisting of fatty alcohols, fatty alcohol alkoxylates, fatty amide ethoxylates, fatty alcohol sulfates, fatty alcohol ether sulfates, alkyl benzene sulfonates, allyl polyglycosides, fatty acid sorbitan esters, alkylamine oxides, alkyl betaines and combinations thereof.

9. The composition of claim 1, wherein the emulsifying substance is present in an amount of from about 0.10% by weight to about 10% by weight of the composition.

10. The composition of claim 1, further comprising a colorant, wherein the colorant is a water-soluble polymer, water-insoluble polymer, a water-soluble dye, a water-insoluble dye, or a combination thereof.

11. The composition of claim 10, wherein the colorant is present in an amount of from about 0.0001% by weight to about 0.5% by weight of the composition.

12. The composition of claim 1, further comprising denatonium benzoate as a bittering agent and dipropylene glycol as a solvent.

13. The composition of claim 1, further comprising water.

14. The composition of claim 1, wherein the composition further comprises less than about 1% by weight of polyethylene glycol in the form of a coating, wherein the coating is solid at room temperature.

15. The composition of claim 1, wherein the composition comprises a plurality of individual particles in the form of melt bodies, wherein:

(a) the melt bodies have a particle size between about 0.5 mm and about 10 mm in any spatial direction, (b) the melt bodies have a particle weight of between about 2 mg and about 150 mg, (c) the melt bodies are solid at temperatures from about 20° C. to about 40° C., and (d) the melt bodies are in a form selected from the group consisting of a pastille, a granule, a pellet, a powder, a pulverized powder, a tablet, and a crystal.

16. A solid, particulate composition for fabric treatment comprising:

(a) from about 20 to about 95 wt. % of sodium acetate trihydrate;

(b) from about 0.1 to about 2 wt. % of PVP/PVI copolymer (c) from about 1.0 to about 5 wt. % of at least one fragrance; and (d) from about 1.0% to about 5 wt. % of tris(hydroxymethyl)aminomethane (TRIS)

wherein wt. % is based on the total weight of the solid, particulate composition.

17. A method of making a composition for fabric treatment according to claim 1, comprising:

mixing said water-soluble carrier and said buffer system to form a mixture;

adding said dye transfer inhibitor (DTI) and said fragrance into the mixture;

mixing the mixture;

heating the mixture and obtaining a melt thereby; and cooling the mixture.

18. The method of claim 17, further comprising forming the melt into individual particles comprising melt bodies.

* * * * *